US006094874A

United States Patent [19]

Manzella

[11] Patent Number: 6,094,874

[45] Date of Patent: Aug. 1, 2000

[54] WINDOW MOUNT SYSTEM

[75] Inventor: Francis Manzella, Rockville Center, N.Y.

[73] Assignee: Thermo-Roll Window Corp., W. Babylon, N.Y.

[21] Appl. No.: 09/048,438

[22] Filed: Mar. 26, 1998

[51] Int. Cl.[7] ..... E06B 3/964

[52] U.S. Cl. ..... 52/204.62; 52/204.51; 52/204.57; 52/204.7; 52/204.6; 49/504; 49/505; 49/DIG. 1; 49/DIG. 2; 49/456; 49/453

[58] Field of Search ..... 52/207, 204.51, 52/204.57, 204.6, 204.62, 204.7; 49/504, 505, DIG. 1, DIG. 2, 456, 454, 453

[56] References Cited

U.S. PATENT DOCUMENTS

| | | | |
|---|---|---|---|
| 1,000,094 | 8/1911 | Klemm | 52/204.7 |
| 3,299,596 | 1/1967 | Neal et al. . | |
| 4,811,532 | 3/1989 | Fratti et al. | 52/204.62 |
| 5,560,149 | 10/1996 | Lafevre | 52/204.62 |
| 5,761,860 | 6/1998 | Koike et al. | 52/204.7 |

OTHER PUBLICATIONS

FIGS 1 & 2 in the Specification.

*Primary Examiner*—Carl D. Friedman
*Assistant Examiner*—Dennis L. Dorsey
*Attorney, Agent, or Firm*—Robert A. Seemann

[57] ABSTRACT

An extruded rail adjacent to the glazing in a window has a pair of integrally extruded receivers adapted to attachingly receive predetermined window glazing bead brackets which are each adapted to mate with the receivers. The glazing can be installed from either the exterior side or the interior side of the window, and can be located closer to one or the other of the sides by attachment sequence and selection of the predetermined bead brackets.

14 Claims, 9 Drawing Sheets

WINDOW MOUNT SYSTEM

BACKGROUND OF THE INVENTION

1. Field of the Invention

The invention relates to mounting of a sash in a window frame, more particularly to a mounting system for a window sash in a window in which the window can be made an inswing or an outswing without turning the window around or turning the sash around, by shifting a sash-frame closure element from one position to another, and the change can be made from the interior of the building on the window mounted in the building wall; and in which the glazing can be installed in the same opening of a sash in any of a plurality of locations between the interior and exterior face of the sash from the interior of the building while the sash is fixed or swingably mounted in the wall.

2. Description of the Prior Art

A three-window PRIOR ART assembly 20 is shown in FIGS. 1 and 2.

Outswing window sash 24 swings toward the exterior 28 of the building in which assembly 20 is mounted. The building is not shown.

Glazing 30 is held between U-shaped bead bracket 34 and L-shaped bead bracket 38. Bead bracket 38 is an integrally extruded portion of vertical stile 42. Bead bracket 34 is held on vertical stile 42 by bracket receiver structure 48 which is an integrally extruded portion of vertical stile 42.

L-shaped bead bracket 66 is an integrally extruded portion of vertical stile 68. Bead bracket 72 is held on vertical stile 68 by bracket receiver structure 74 which is an integrally extruded portion of vertical stile 68.

When window sash 24 is drawn back into window frame jambs 50 and 52, sash-to-frame closure bracket 56 closes to exterior face 58 of jamb 50, and vertical stile 42 closes to frame-to-sash closure bracket 60.

Sash-to-frame closure bracket 56 is an integrally extruded portion of vertical stile 42. Frame-to-sash closure bracket 60 is an integrally extruded portion of jamb 50.

Glazing 30 cannot be installed in window sash 24 from the interior 32 of the building when the sash is installed in the window frame because insertion of the glazing from the interior or room side against glazing bead bracket s 34 and 72 is prevented by L-shaped bead bracket 38 which is permanently attached to stile 42 and by L-shaped bracket 66 which is permanently fixed to vertical stile 68.

Window sash 24 includes vertical stiles 42 and 68. The sash cannot be installed in window frame 76 which includes jambs 50 and 52, from the interior of the building when the window frame is installed in the wall of the building, because insertion of the sash from the interior or room side into frame 76 is prevented by frame-to-sash closure bracket 60 which is permanently attached to window frame jamb 50, frame-to-sash closure bracket 78 which is permanently fixed to window frame jamb 52, sash-to-frame closure bracket 56 which is permanently attached to stile 42, and sash-to-frame closure bracket 77 which is an integrally extruded portion of stile 68 permanently attached thereto.

Window sash 24 can be installed in window frame 76 only from one side of the window when the window is installed in a wall of a building, that is from the exterior of the building.

Glazing 30 can be installed in window sash 24 only from one side of the window when the window is installed in a wall. That is from the exterior 28 of the building, by inserting glazing 30 in between stiles 42 and 68 against permanent beads 38 and 66, and then snapping bead bracket 34 onto stile 42 by bracket receiver structure 48 and snapping bead bracket 72 onto stile 68 by bracket receiver structure 74.

Window frame 104 includes jamb 52 and jamb 106.

Glazing 96 of non-swing window 100 cannot be installed in window frame 104 from the interior 32 of the building when the window frame is installed in the wall of the building because frame-to-glazing bead L-shaped bracket 110 and frame-to-glazing bead L-shaped bracket 112 prevent insertion of glazing 96 from the room or interior 32 side.

Bead bracket 110 is an integrally extruded portion of jamb 52, permanently attached thereto. Bead bracket 112 is an integrally extruded portion of jamb 106, permanently attached thereto.

Glazing 96 can be installed in window frame 104 only from one side of the window frame when the window frame is installed in a building wall. That is from the exterior 28 of the building, by inserting glazing 96 in between jambs 52 and 106, against permanent bead brackets 110 and 112. Then U-shaped bead bracket 118 is snapped onto jamb 52 by bracket receiver structure 120 which is an integrally extruded portion of jamb 52, permanently attached thereto. And U-shaped bead bracket 124 is snapped onto jamb 106 by bracket receiver structure 126 which is an integrally extruded portion of jamb 106, permanently attached thereto.

Inswing window sash 130 of window 132 swings toward the interior 32 of the building. Sash 130 includes stiles 134 and 136. Window frame 140 includes jambs 108 and 144.

Sash 130 cannot be installed in window frame 140 from the exterior 28 of the building when the window frame is installed in the wall of the building. Insertion of sash 130 into frame 140 from the exterior of the building is prevented by stile-to-frame closure brackets 146 and 148.

Bracket 146 is an integrally extruded portion of stile 134, permanently attached thereto. Bracket 148 is an integrally extruded portion of stile 136, permanently attached thereto.

Insertion of sash 130 into frame 140 is also prevented by frame to stile closure brackets 154 and 158.

Bracket 154 is an integrally extruded portion of window jamb 108, permanently attached thereto. Bracket 158 is an integrally extruded portion of jamb window jamb 144, permanently attached thereto.

Glazing 152 of sash 130 cannot be installed in window frame 140 from the exterior of the building when the sash is closed in frame 140 in the building wall. Insertion of glazing 152 into frame 140 to glazing bead brackets 166 and 168 is prevented by L-shaped glazing bead brackets 170 and 172.

Bracket 170 is an integrally extruded portion of stile 134. Bracket 172 is an integrally extruded portion of stile 136.

Sash 130 and glazing 152 can be installed from the interior or room side of the building when window 132 is installed in the wall of the building.

Glazing 152 is installed by inserting the glazing from the room side, between stiles 134 and 136 until the glazing abuts against permanent glazing bead brackets 170 and 172. Then glazing bead bracket 166 is snapped onto bracket receiver structure 176 which is an integrally extruded portion of stile 134. And glazing bead bracket 168 is snapped onto bracket receiver structure 178 which is an integrally extruded portion of stile 136.

If inswing and outswing windows are required in the same opening, two separate windows mulled together would be provided.

SUMMARY OF THE INVENTION

It is one object of the invention to provide one window which accommodates both inswing and outswing.

It is another object of the invention to provide a mounting system for a window sash in which the sash can be installed in the window frame from either the interior or the exterior of the building when the window frame is mounted in a wall of the building.

It is another object of the invention to provide a mounting system for window glazing in which the glazing can be installed in the window sash from either the interior or the exterior of the building when the window frame is mounted in a wall of the building.

It is another object of the invention to provide a mounting system for window glazing in which the glazing can be installed in the window frame from either the interior or the exterior of the building when the window frame is mounted in a wall of the building.

It is another object that the beading which holds the glazing can be installed in an outswing window sash from the interior of the building.

It is another object that the beading on the exterior side and on the interior side of the glazing are interchangeable.

It is another object that a stile of the window includes receiver structures adapted to attach the exterior side and interior side glazing beads to the stile.

It is another object that a jamb of the window includes receiver structures adapted to attach the exterior side and interior side glazing beads to the stile.

It is another object that a jamb of the window includes receiver structures adapted to attach brackets adapted to seal between frame and sash.

It is another object that a swingable window can be made an inswing or an outswing window without turning the window around in a wall.

Other objects and advantages will become apparent from reading the ensuing description of the invention.

A window includes glazing, a rail adjacent to the glazing, and a first bracket receiver integrally extruded portion of the rail configured to attachingly receive a first predetermined window glazing bead bracket adapted to hold the glazing, a first window glazing bead bracket adapted to mate with the first bracket receiver and to hold the glazing, a second bracket receiver integrally extruded portion of the rail configured to attachingly receive a second predetermined window glazing bead bracket adapted to hold the glazing, and a second window glazing bead bracket adapted to mate with the second bracket receiver and to hold the glazing.

In one arrangement the first bracket receiver is configured to attachingly receive the second window glazing bead bracket.

In another arrangement one of the first window glazing bead bracket and the second window glazing bead bracket comprises a decorative curved outer surface.

In another arrangement the first window glazing bead bracket is attachingly mated with the first bracket receiver and comprises a sheath strip that extends over a side of the first window glazing bead bracket and a side of the rail along a substantial portion of the length of the rail.

The first window glazing bead bracket is attached to the rail by the first bracket receiver and is connected to a first side of the glazing, and the second window glazing bead bracket is attached to the rail by the second bracket receiver and is connected to a second side of the glazing.

In another arrangement the window further includes a third bracket receiver integrally extruded portion of the rail configured to attachingly receive a predetermined bracket adapted for closing a space between a sash and a frame.

BRIEF DESCRIPTION OF THE DRAWINGS

In order that the invention be more fully comprehended, it will now be described, by way of example, with reference to the accompanying drawings, in which:

PRIOR ART three-window ASSEMBLY 20 is shown in FIGS. 1 and 2.

FIG. 3 is a schematic cross section view of a three-window assembly.

FIG. 4 is a schematic cross section view of a portion of a window assembly.

FIG. 5 is a schematic cross section view of the assembly of FIG. 4 with a different attachable bracket.

FIG. 6 is a schematic cross section view of a portion of a window assembly.

FIG. 7 is a schematic cross section view of the assembly of FIG. 4 with different attachable brackets.

FIG. 8 is a cross section view of a strip of the assembly of FIG. 4.

FIG. 9 is a cross section view of a strip of the assembly of FIG. 4.

FIG. 10 is an elevation exterior view of a window.

DESCRIPTION OF THE PREFERRED EMBODIMENTS

Figure 1:
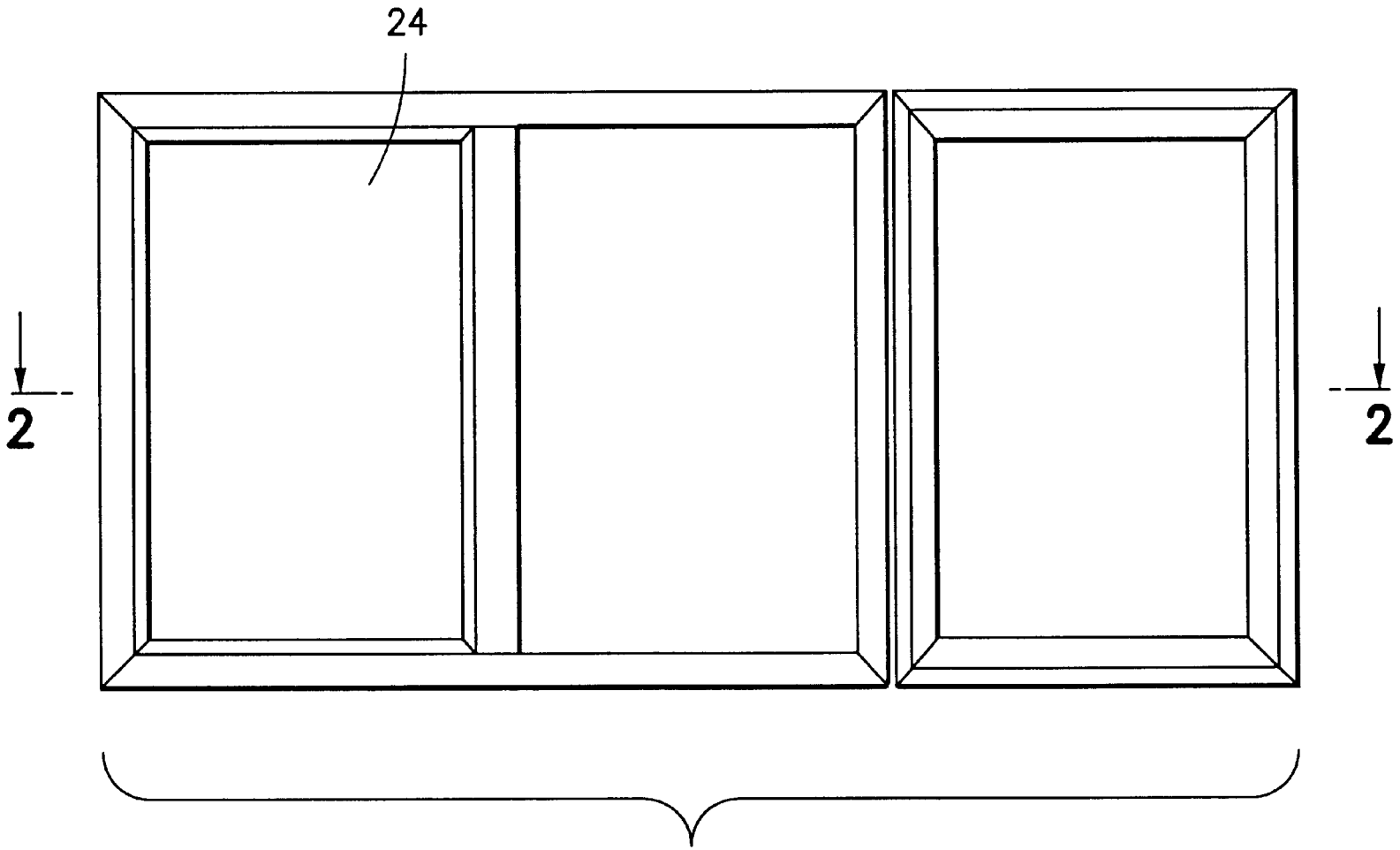
FIG. 1 PRIOR ART
FIG. 1 is an elevation view of the three window assembly viewed from the interior of the building.
Figures 2, 2A, 2B:
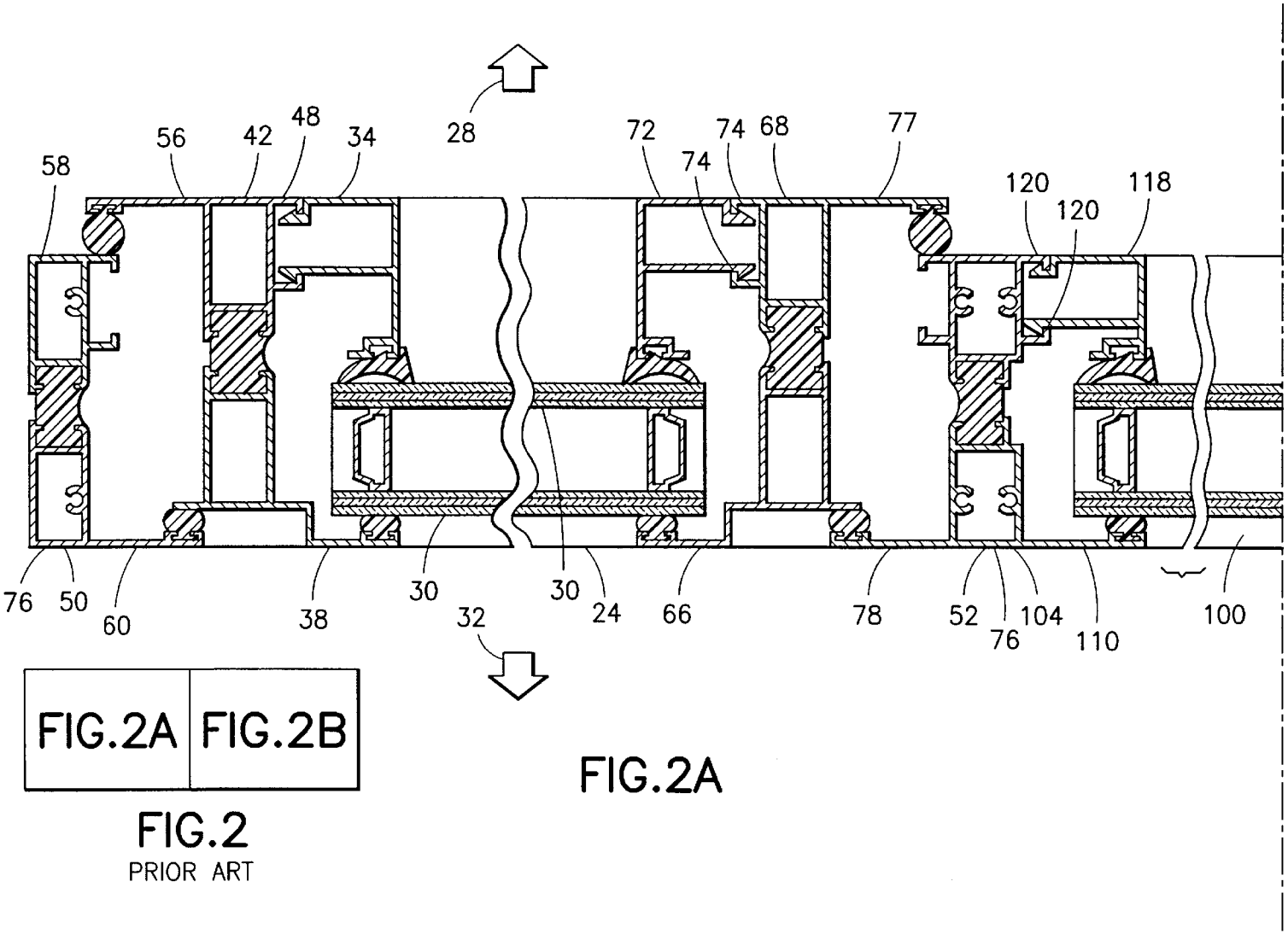
FIG.2 PRIOR ART
FIG. 2 is a schematic cross section view of the three-window assembly viewed along 2—2. The bottom sill of the three-window assembly is omitted for clarity of the drawing.
Figure 2B:
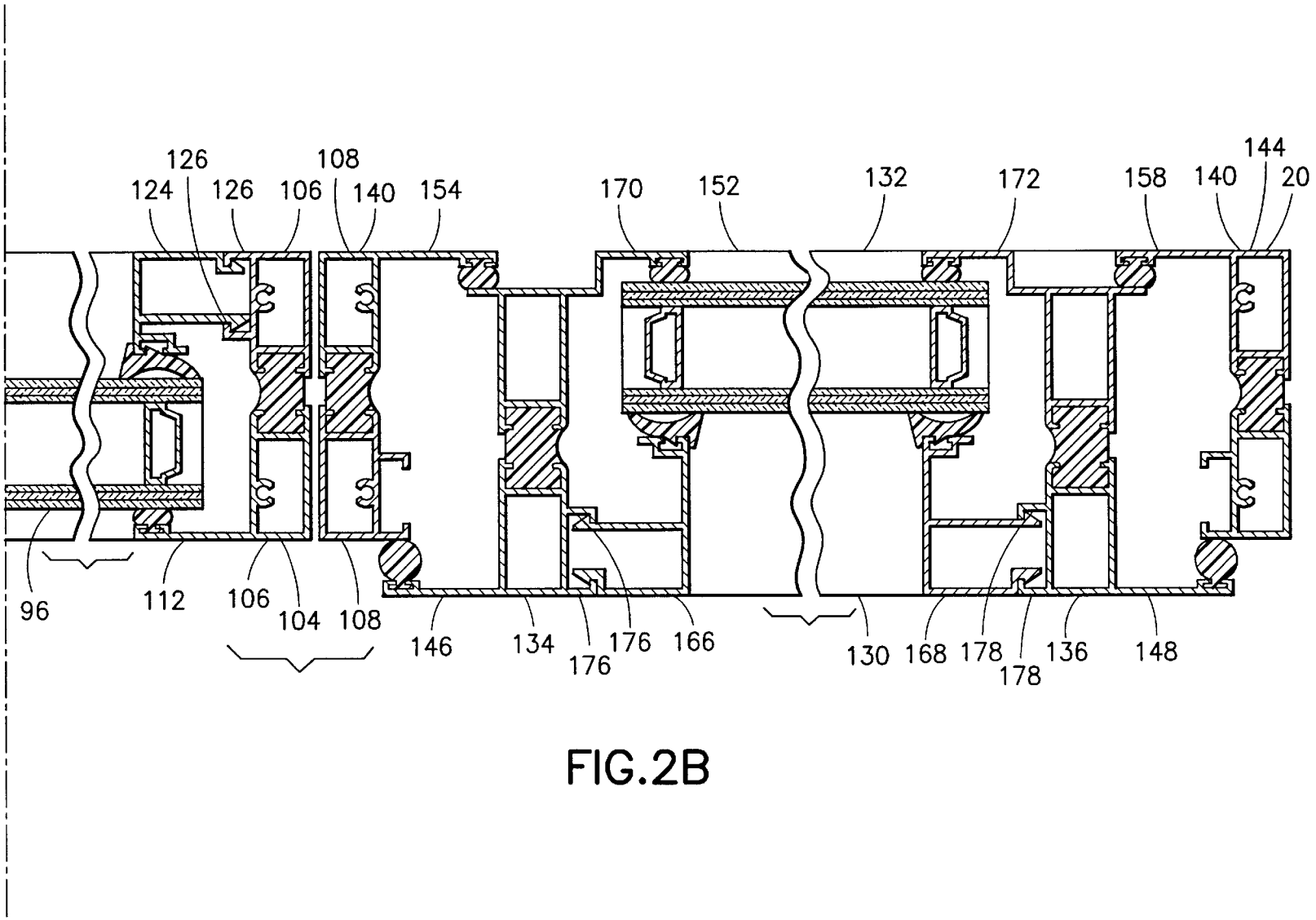

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figures 3, 3A, 3B:
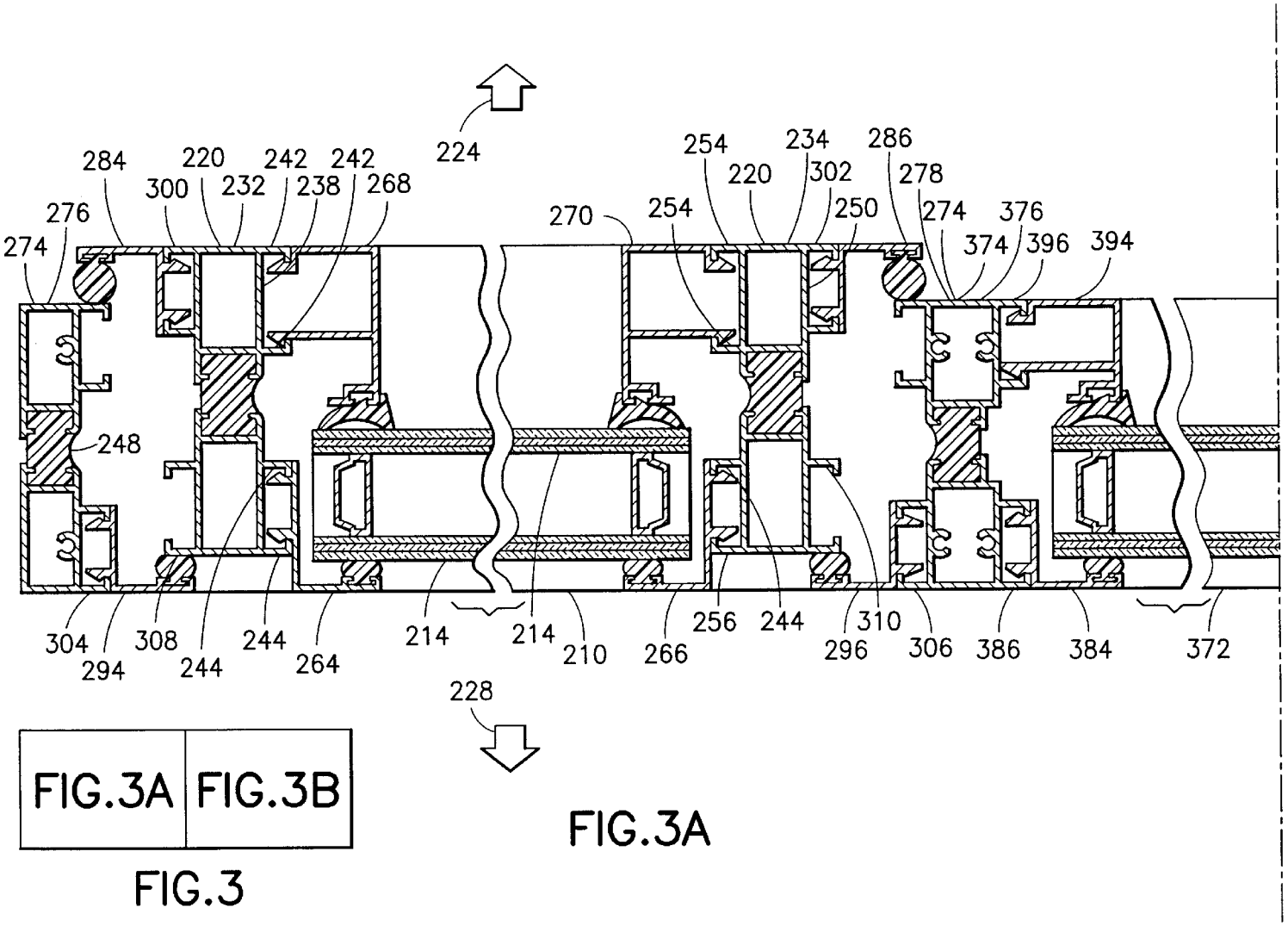
FIGS. 3 through 10 are of the invention.
Figure 3B:
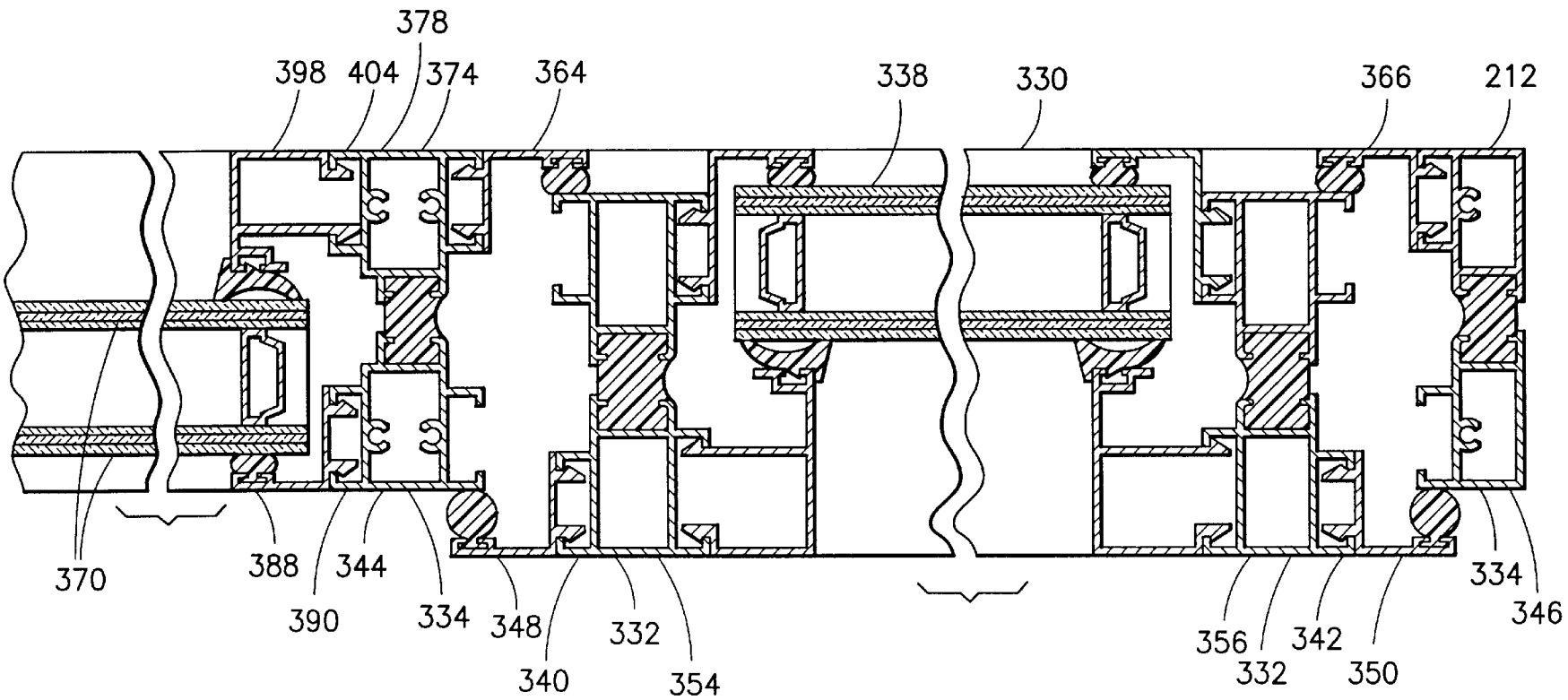

Referring now to FIG. 3, 3-window assembly 212 includes outswing window 210, fixed window 372, and inswing window 330. Conversions in swing of the sash and in position of the glazing within each window of assembly 212 can be made without interchanging or rotating the windows. The changes can be made by working from the safety and convenience of the interior of the building. This will be explained by describing how various conversion elements and portions of each window can be installed working at one's option from either the interior or the exterior of the building while 3-window assembly 212 is permanently mounted in the building wall.

In FIG. 3, glazing 214 of window 210 of 3-window assembly 212 can be installed in sash 220 from two directions. When window assembly 212 is installed in a building wall, glazing 214 can be installed from the exterior 224 of the building or from the interior 228 of the building.

Outswing sash 220 includes stiles 232 and 234. Inward facing side 238 of stile 232 has bracket receiver structures 242 and 244 which are each an integrally extruded portion of stile 232.

The stiles are extruded by any method known, are preferably made of metal, and are insulated by pouring a hardening insulating material 248 in a longitudinal portion of the stile between the exterior and the interior side of the extrusion and cutting a longitudinal slot through the metal extrusion to the insulating material to form a gap in the metal extrusion to reduce the rate of heat transfer by conduction through the stile between the interior side and the exterior side.

Inward facing side 250 of stile 234, the side that is toward the glazing, has bracket receiver structures 254 and 256 which are each an integrally extruded portion of stile 234.

The bracket receiver structures of the invention are configured to attachingly receive predetermined window glazing bead brackets and window closure brackets which are adapted to mate with the bracket receiver structures to make the attachment. Preferably they are also detachable. Accordingly, the term "attachingly received" does not mean that a bracket that is "attachingly received" is not detachable because it is attachingly received.

When glazing 214 is installed from exterior 224 it is inserted between stiles 232 and 234 until the glazing stops against detachable L-shaped glazing bead bracket 264 which is configured to snap onto bracket receiver structure 244, and the glazing stops against detachable L-shaped glazing bead bracket 266 which is configured to snap onto bracket receiver structure 256.

Then, detachable U-shaped glazing bead bracket 268 which is configured to snap onto bracket receiver structure 242 is snapped thereon, and detachable U-shaped glazing bead bracket 270 which is configured to snap onto bracket receiver structure 254 is snapped thereon.

When glazing 214 is installed from interior 228, it is inserted between stiles 232 and 234 until the glazing stops against U-shaped glazing bead brackets 268 and 270 which are respectively snapped onto bracket receiver structures 242 and 254 for which they are adapted. Then L-shaped glazing bead bracket 264 is snapped onto bracket receiver structure 244 for which it is adapted and L-shaped glazing bead bracket 266 is snapped onto bracket receiver structure 256 for which it is adapted.

The U-shaped glazing beads are preferably detachable. They may be made with sufficient flexibility so that they can be squeezed down in width and slipped out of the bracket receiver structures.

The L-shaped glazing beads are preferably detachable. They may be made with sufficient tolerance to be pryable away from their grip with the bracket receiver structure.

Sash 220 may be installed in window frame 274 from interior 228 or from exterior 224. Window frame 274 includes window frame jambs 276 and 278.

The jambs are extruded by any method known, are preferably made of metal, and are preferably insulated by pouring a hardening insulating material 248. In a longitudinal portion of the jamb between the exterior and the interior side of the extrusion and cutting a longitudinal slot through the metal extrusion to the insulating material to reduce the rate of heat transfer by conduction through the jamb between the interior side and the exterior side.

In installing the sash from the interior, the sash is attached to the frame by a horizontal axis at the bottom of the sash without detachable sash-to-frame closure brackets 284 and 286, and without detachable frame-to-sash closure brackets 294 and 296.

The horizontal axis is positioned at the bottom of the sash according to known engineering practices, in order to provide the swing, and is therefore not shown.

The sash is then rotated outward so that bracket receiver structures 300 and 302 are clear of jambs 276 and 278, and brackets 284 and 286 are snapped onto bracket receiver structures 300 and 302. Brackets 294 and 296 are snapped onto bracket receiver structures 304 and 306.

Bracket receiver structures 304, and 308 are integrally extruded portions of jamb 276 and stile 232 respectively. Bracket receiver structures 306, and 310 are integrally extruded portions of jamb 278 and stile 234 respectively.

Inswing window 330 and sash 332 are of the same construction as window 210 and sash 220. Glazing 338 and sash 332 can be installed in window frame 334 from exterior 224 or from interior 228.

The window is mounted on a horizontal axis positioned on the sash according to known engineering practice to permit tilt of the window.

In installing from the exterior, the window is tilted to the interior so that bracket receiver structures 340 and 342 are clear of jambs 344 and 346. Then detachable L-shaped sash-to-frame brackets 348 and 350 are attached to stiles 354 and 356 respectively. Then detachable L-shaped frame-to-sash brackets 364, 366 are attached to jambs 344, 346 respectively. It is seen by comparing the mounting of sash-to-closure brackets 284 with 348 and 294 with 364 that sash 220 which can swing out of frame 274 in direction 224, can be made able to swing out of frame 274 in direction 228, similarly to the swing of sash 332 out of frame 334, by installing a sash-to closure bracket in the free bracket receiver structure shown in jamb 276 and installing a sash-to-closure bracket in the free bracket receiver structure shown in stile 232, like the jamb 344 to stile 354 sash-to-closure bracket configuration, and not having a sash-to-closure bracket in bracket receiver structures 300 and 304. Sash-to-closure brackets on the opposite side of sash 220 would be installed to match, so that sash 220 can swing out in direction 228, and back in against the sash-to-closure brackets.

Glazing 370 of non-swing window 372 can be installed in window frame 374 from two sides, exterior 224 of the building and interior 228 of the building when window 372 is mounted in a wall of the building.

Window frame 374 includes window jambs 376 and 378.

In installing glazing 370 from exterior 224. Detachable L-shaped frame to glazing bead bracket 384 is attached to jamb 376 by bracket receiver structure 386 which is an integrally extruded portion of jamb 376, and detachable L-shaped frame to glazing bead bracket 388 is attached to jamb 378 by bracket receiver structure 390 which is an integrally extruded portion of jamb 378.

Then glazing 370 is inserted between jambs 376 and 378 until it abuts against brackets 384 and 388.

Then detachable U-shaped glazing bead bracket 394 is attached to jamb 376 by bracket receiver structure 396 which is an integrally extruded portion of jamb 376, and detachable U-shaped glazing bead bracket 398 is attached to jamb 378 by bracket receiver structure 404 which is an integrally extruded portion of jamb 378.

In installing glazing 370 from interior 228, glazing bead brackets 394 and 398 are attached respectively to jambs 376 and 378 by bracket receiver structures 396 and 404.

Then glazing 370 is inserted between jambs 374 and 376 until the glazing abuts glazing bead brackets 394 and 398.

Then bead brackets 384 and 388 are attached respectively to jambs 376 and 378 by bracket receiver structures 386 and 390.

Figure 4:
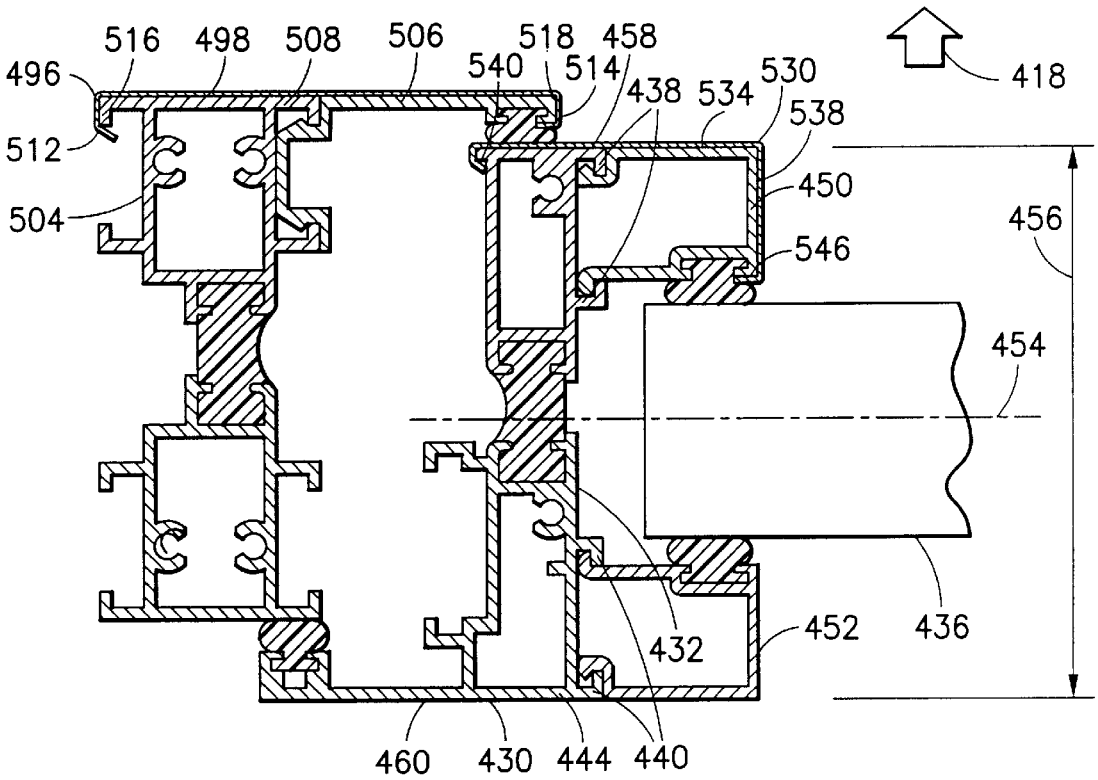

In FIG. 4 on sash 430 inward facing side 432 which is toward glazing 436, two identical bracket receiver structures 438 and 440 are each an integrally extruded portion of stile 444.

Bracket receiver structures 438 and 440 are configured to attach bead brackets 450 and 452 to stile 444. Bead brackets 450 and 452 are shaped so that glazing 436 is at the middle region 454 of the width 456 from the exterior longitudinal edge 458 to the interior longitudinal edge 460 of the stile.

Figure 5:
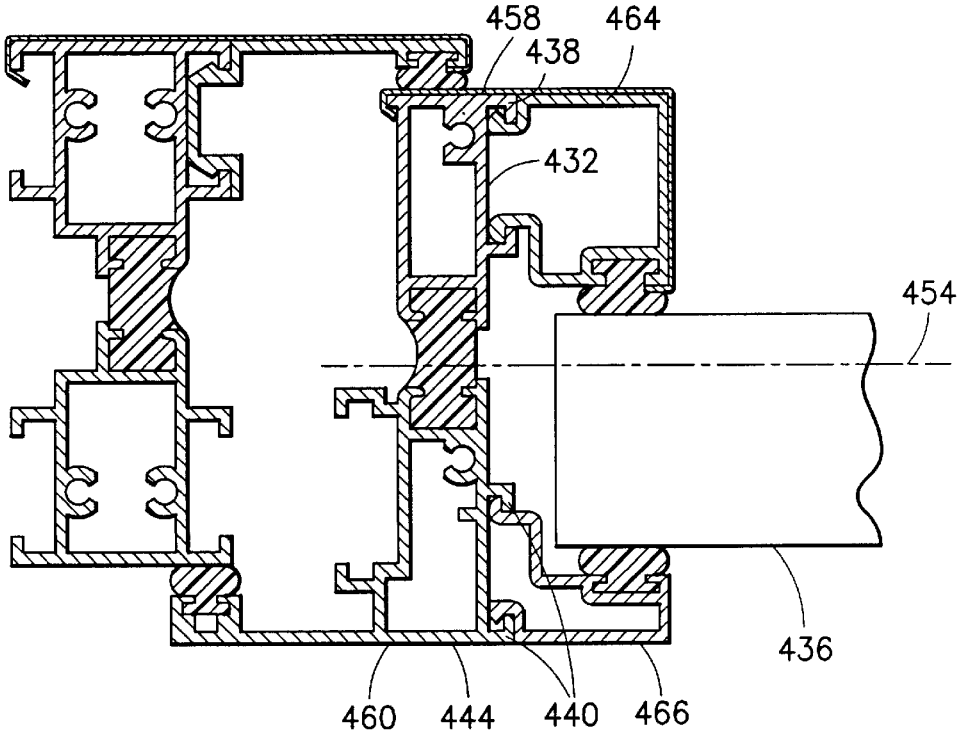

In FIG. 5, detachable bead brackets 464 and 466 are shaped so that glazing 436 is closer to interior longitudinal edge 460 of the stile than the glazing is to exterior longitudinal edge 458 of the stile.

Bead brackets 464 and 466 can be switched in bracket receiver structures so that glazing 436 is closer to edge 458 than edge 460 by snapping bead bracket 466 in bracket receiver structure 438 and snapping bead bracket 464 in bracket receiver structure 440.

Other sets of detachable bead brackets adapted to attach to one side of stile 444 by bracket receiver structures 438 and 440 may be provided in shapes to fit different thickness glazing and to position the glazing predetermined distances from edges 458 and 460.

Sets of detachable bead brackets adapted to attach to one side of a stile by bracket receiver structures on the side are shown in FIG. 3. See bracket sets 384, 394, and 264, 268.

Figure 6:
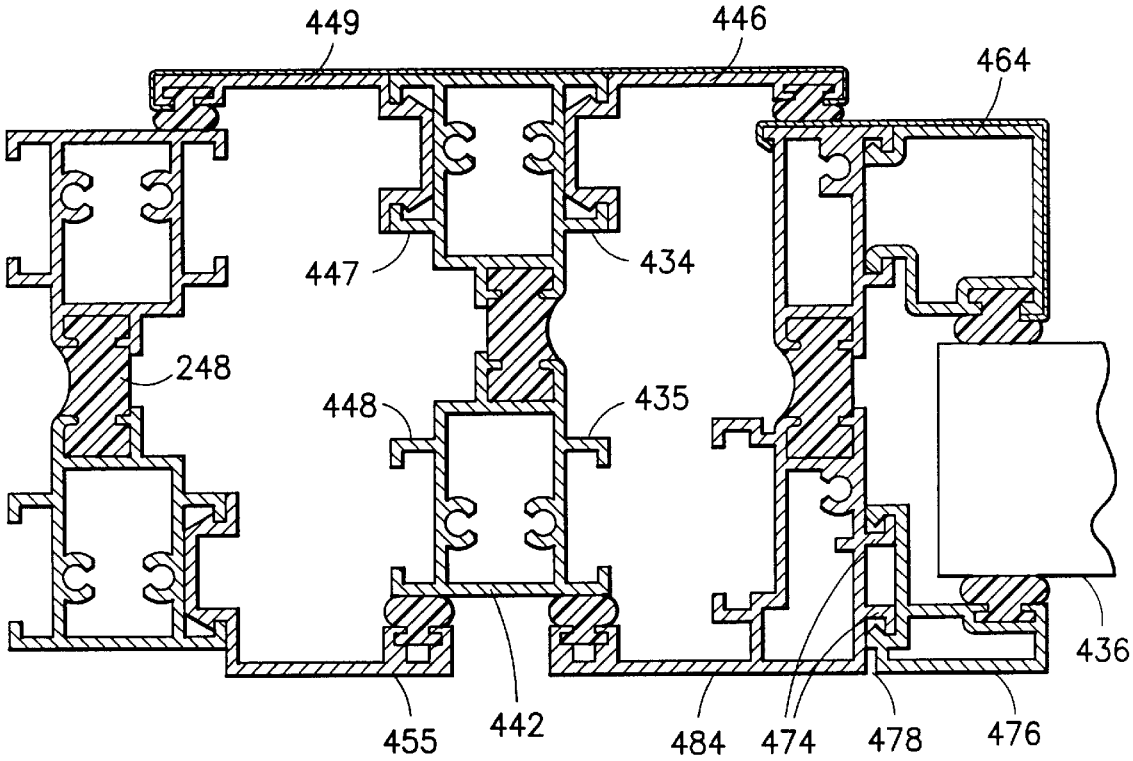

FIG. 6 shows bracket receiver structure 474 of the invention configured to attachingly receive predetermined window glazing bead bracket 476 which is adapted to mate with the bracket receiver structure to make the attachment. Preferably bead bracket 476 is detachable. Slot 478 permits insertion of a screw driver between bracket 476 and stile 484 to aid in removal of the bracket from the bracket receiver structure.

Bracket receiver structures 434 and 435 of jamb 442 are adapted to attachingly receive frame-to-stile closure bracket 446. It is seen from FIG. 6 that the sash of stile 484 can be changed from an inswing to an outswing without turning around the window frame of jamb 442 or removing the window frame from a wall, by moving frame-to-stile closure bracket 446 from frame jamb bracket receiver 434 to frame jamb bracket receiver 435, similarly around the frame, and reversing or turning around the sash in the frame.

Bracket receiver structures 447 and 448 are adapted to attachingly receive frame-to-stile closure bracket 449.

Frame-to-stile closure brackets 446, 449, and 455 are each adapted to attachingly fit bracket receiver structures 434, 435, 447, and 448.

Figure 7:
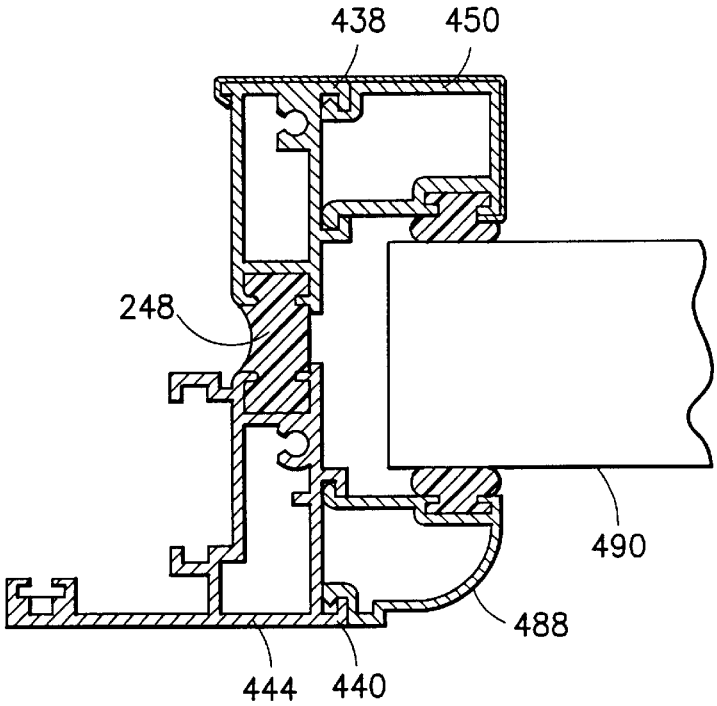

FIG. 7 shows curved-profile bead bracket 488 attached to stile 444 by bracket receiver structure 440, holding glazing 490 with bead bracket 450. Bead bracket 488 is an extrusion shown in cross section.

Figure 8:
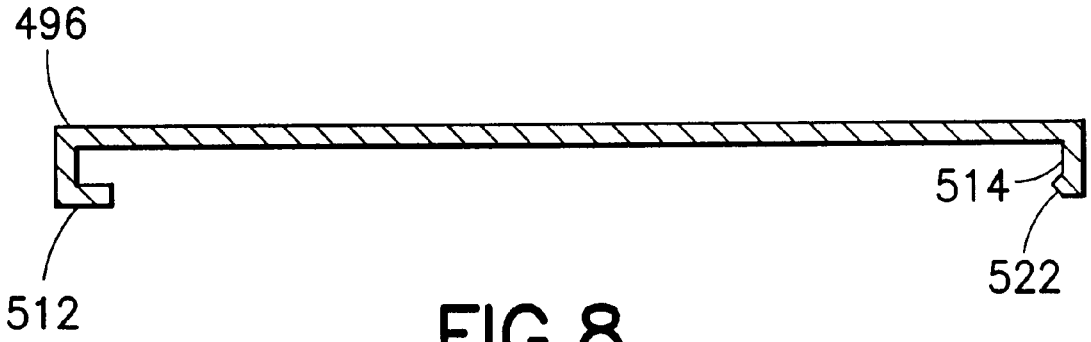
Figure 9:
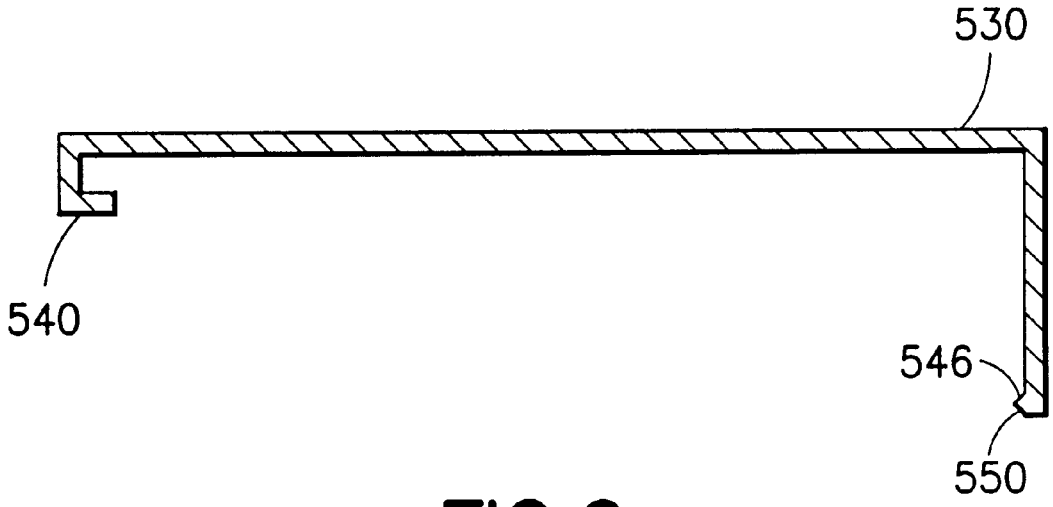

In FIGS. 4, 8 and 9, strip 496 is formed to closely fit and cover the longitudinal exterior edge 498 of window frame jamb 504 and the adjacent parallel exterior longitudinal side of frame-to-stile closure bracket 506 which is attached to jamb 504 by bracket receiver structure 508. Strip 496 is preferably painted on the exterior side and presents a uniform appearance. The strip is preferably roll formed from 6063-T5 aluminum or 1100-H14 aluminum, about 0.020 inches thick. It is formed to grip the combined jamb and bracket by portions 512 and 514 of the strip that fold back under strip 496. Strip 496 can be mounted on combined jamb and bracket by sliding on the extruded jamb and bracket from one end. Strip 496 can also be mounted by snapping it over the combined jamb and bracket by catching it on jamb 504 longitudinal outward edge 516 by portion 512, and swinging it down until ramped portion 522 snaps past longitudinal inward edge 518 of frame-to-stile closure bracket 506.

Strip 530 is formed to closely fit and cover the exterior longitudinal edge 458 of stile 444 extrusion and the exterior longitudinal side 534 and inward side 538 of bead bracket 450 which is attached to stile 444 by bracket receiver structure 438. It is attached by catching turned-under portion 540 on the stile and catching turned under portion 546 on bead bracket 450 by sliding ramped portion 550 down and past inward side 538 of bead bracket 450.

Figure 10:
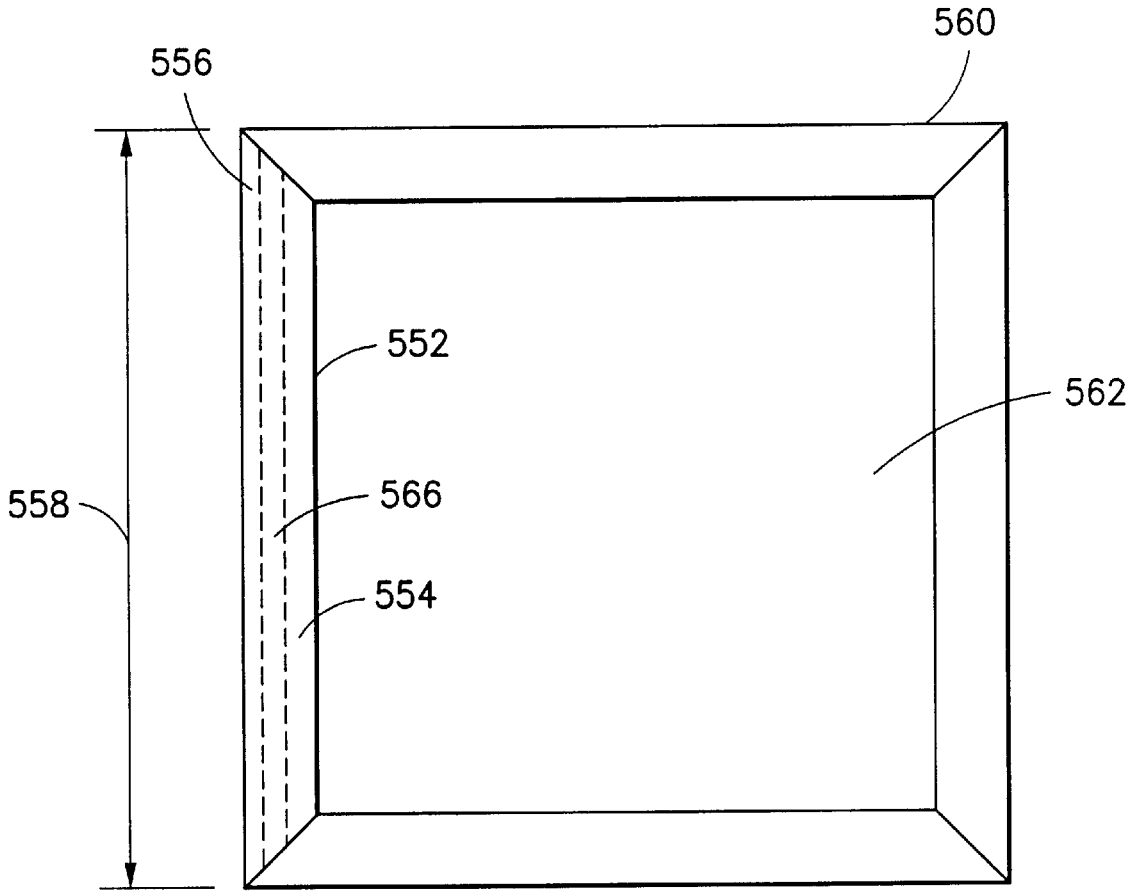

FIG. 10 shows strip 552 extending over bead bracket 554 and stile 556 over a substantial portion of the length 558 of stile 556 which is adjacent to glazing 562 of window 560. Bead bracket 554 is attached to stile 556 by bracket receiver structure 566 which is an integrally extruded portion of stile 556.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. In a window frame having a first side and a second side and a sash mounted on said frame for swinging from a first position in said frame, to at least one of a second position on the first side, and a third position on the second side, an apparatus comprising:

a frame jamb-rail, a first bracket receiver, said first bracket receiver is an integrally extruded portion of said jamb-rail, a first frame-to-sash closure bracket detachably mounted on said first bracket receiver, a sash stile-rail, a second bracket receiver, said second bracket receiver is an integrally extruded portion of said stile-rail, a second frame-to-sash closure bracket detachably mounted on said second bracket receiver, a third bracket receiver, said third bracket receiver is an integrally extruded portion of said stile-rail, said first frame-to-sash closure bracket being in closing connection with said sash, and said second frame-to-sash closure bracket being in closing connection with said frame, so that said sash is swingable from the first position in closing connection with the frame by the first and second frame-to-sash closure brackets, to the second position out of closing connection with the frame, said first frame-to-sash closure bracket being detachably mountable on said third bracket receiver in closing connection with said frame, so that said sash is swingable from the first position in closing connection with the frame to the third position out of closing connection with the frame when said second frame-to-sash closure bracket is removed from said second bracket receiver.

2. The window of claim 1 further comprising:

said jamb-rail having a length, and a sheath strip detachably mounted on said first frame-to-sash closure bracket, extending over a side of said first frame-to-sash closure bracket and over a side of said jamb-rail along a substantial portion of the length of said jamb-rail.

3. The window of claim 1 wherein said third bracket receiver and said second bracket receiver are on a side of said jamb-rail that faces oppositely away from said sash.

4. The apparatus of claim 1, further comprising:

a fourth bracket receiver, said fourth bracket receiver is an integrally extruded portion of said jamb-rail, said second frame-to-sash closure bracket being detachably mountable on said fourth bracket receiver in closing connection with said sash, so that said sash is swingable from the first position in closing connection with the frame to the third position out of closing connection with the frame.

5. The window of claim 4 wherein said first bracket receiver and said fourth bracket receiver are spaced from each other laterally to the length of said jamb-rail.

6. The window of claim 4 further comprising:

a fifth bracket receiver, said fifth bracket receiver is an integrally extruded portion of said stile-rail, first window glazing bead bracket mounted on said fifth bracket receiver, said stile-rail having a length, and a sheath strip detachably mounted on said first window glazing bead bracket extending over a side of said first window glazing bead bracket and over a side of said stile-rail along a substantial portion of the length of said stile-rail.

7. In a window frame having a first side and a second side and a sash mounted on said frame for swinging from a first position in said frame, to at least one of a second position on the first side, and a third position on the second side, an apparatus comprising:

a frame jamb-rail, a first bracket receiver, said first bracket receiver is an integrally extruded portion of said jamb-rail, a first frame-to-sash closure bracket detachably mounted on said first bracket receiver, a sash stile-rail, a second bracket receiver, said second bracket receiver is an integrally extruded portion of said stile-rail, a second frame-to-sash closure bracket detachably mounted on said second bracket receiver, a third bracket receiver, said third bracket receiver is an integrally extruded portion of said stile-rail, said first frame-to-sash closure bracket being in closing connection with said sash, and said second frame-to-sash closure bracket being in closing connection with said frame, so that said sash is swingable from the first position in closing connection with the frame by the first and second frame-to-sash closure brackets, to the second position out of closing connection with the frame, said second frame-to-sash closure bracket being detachably mountable on said third bracket receiver in closing connection with said frame, so that said sash is swingable from the first position in closing connection with the frame to the third position out of closing connection with the frame when said first frame-to-sash closure bracket is removed from said first bracket receiver.

8. The window of claim 7 further comprising:

said jamb-rail having a length, and a sheath strip detachably mounted on said first frame-to-sash closure bracket, extending over a side of said first frame-to-sash closure bracket and over a side of said jamb-rail along a substantial portion of the length of said jamb-rail.

9. The apparatus of claim 7, further comprising:

a fourth bracket receiver, said fourth bracket receiver is an integrally extruded portion of said jamb-rail, said first frame-to-sash closure bracket being detachably mountable on said fourth bracket receiver in closing connection with said sash, so that said sash is swingable from the first position in closing connection with the frame to the third position out of closing connection with the frame.

10. The window of claim 9 further comprising:

a fifth bracket receiver, said fifth bracket receiver is an integrally extruded portion of said stile-rail, a first window glazing bead bracket mounted on said fifth bracket receiver, said stile-rail having a length, and a sheath strip detachably mounted on said first window glazing bead bracket, extending over a side of said first window glazing bead bracket and over a side of said stile-rail along a substantial portion of the length of said stile-rail.

11. In a window frame having a first side and a second side and a sash mounted on said frame for swinging from a first position in said frame, to at least one of a second position on the first side, and a third position on the second side, an apparatus comprising:

a frame jamb-rail, a first bracket receiver, said first bracket receiver is an integrally extruded portion of said jamb-rail, a first frame-to-sash closure bracket detachably mounted on said first bracket receiver, a second bracket receiver, said second bracket receiver is an integrally extruded portion of said jamb-rail, a sash stile-rail, a third bracket receiver, said third bracket receiver is an integrally extruded portion of said stile-rail, a second frame-to-sash closure bracket detachably mounted on said third bracket receiver, said first frame-to-sash closure bracket being in closing connection with said sash, and said second frame-to-sash closure bracket being in closing connection with said frame, so that said sash is swingable from the first position in closing connection with the frame by the first and second frame-to-sash closure brackets, to the second position out of closing connection with the frame, said first frame-to-sash closure bracket being detachably mountable on said second bracket receiver in closing connection with said sash, so that said sash is swingable from the first position in closing connection with the frame to the third position out of closing connection with the frame when said second frame-to-sash closure bracket is removed from said third bracket receiver.

12. The window of claim 11 further comprising:

said jamb-rail having a length, and a sheath strip detachably mounted on said first frame-to-sash closure bracket, extending over a side of said first frame-to-sash closure bracket and over a side of said jamb-rail along a substantial portion of the length of said jamb-rail.

13. The window of claim 11 further comprising:

a fourth bracket receiver, said fourth bracket receiver is an integrally extruded portion of said stile-rail, a first window glazing bead bracket mounted on said fourth bracket receiver, said stile-rail having a length, and a sheath strip detachably mounted on said first window glazing bead bracket, extending over a side of said first window glazing bead bracket and over a side of said stile-rail along a substantial portion of the length of said stile-rail.

14. In a window frame having a first side and a second side and a sash mounted on said frame for swinging from a first position in said frame, to at least one of a second position on the first side, and a third position on the second side, an apparatus comprising:

a frame jamb-rail, a first bracket receiver, said first bracket receiver is an integrally extruded portion of said jamb-rail, a first frame-to-sash closure bracket detachably mounted on said first bracket receiver, a second bracket receiver, said second bracket receiver is an integrally extruded portion of said jamb-rail, said first frame-to-sash closure bracket being in closing connection with said sash so that said sash is swingable from the first position in closing connection with the frame by the first frame-to-sash closure bracket, to the second position out of closing connection with the frame, said first frame-to-sash closure bracket being detachably mountable on said second bracket receiver in closing connection with said sash, so that said sash is swingable from the first position in closing connection with the frame to the third position out of closing connection with the frame.

* * * * *